US008360049B2

(12) United States Patent
Stephens

(10) Patent No.: US 8,360,049 B2
(45) Date of Patent: Jan. 29, 2013

(54) WINDSCREEN FOR FIRE

(76) Inventor: Blake Stephens, Cincinnati, OH (US)

( * ) Notice: Subject to any disclaimer, the term of this patent is extended or adjusted under 35 U.S.C. 154(b) by 185 days.

(21) Appl. No.: 12/150,015

(22) Filed: Apr. 24, 2008

(65) Prior Publication Data

US 2008/0277541 A1 Nov. 13, 2008

Related U.S. Application Data

(60) Provisional application No. 60/925,986, filed on Apr. 24, 2007.

(51) Int. Cl.
*F24B 1/18* (2006.01)

(52) U.S. Cl. ..... 126/500; 126/30; 126/59; 248/188.1; 248/188.8; 248/346.01

(58) Field of Classification Search ..... 248/188.6, 248/188.1, 188.8, 176.1, 205.1, 220.21, 220.22, 248/295.11, 297.21, 309.1, 310, 346.01, 248/346.03; 126/25 B, 25 R, 500, 544, 551, 126/547, 553, 512, 30, 59; 256/26, 73
See application file for complete search history.

(56) References Cited

U.S. PATENT DOCUMENTS

| | | | | |
|---|---|---|---|---|
| 42,879 A | | 5/1864 | Savier | |
| 961,976 A | | 6/1910 | Long | |
| 1,491,080 A | | 4/1924 | Clark | |
| 3,494,349 A | * | 2/1970 | Allen | 126/25 B |
| 3,831,542 A | | 8/1974 | Krebs | |
| 4,024,851 A | | 5/1977 | Boda | |
| 4,108,142 A | | 8/1978 | Barson et al. | |
| 4,138,987 A | | 2/1979 | Fromman | |
| 4,196,714 A | | 4/1980 | Fromman | |
| 4,732,138 A | | 3/1988 | Vos | |
| 4,838,525 A | * | 6/1989 | Snow et al. | 256/26 |
| 5,329,917 A | * | 7/1994 | Young | 126/29 |
| 5,682,872 A | * | 11/1997 | Whitted | 126/29 |
| 5,979,434 A | * | 11/1999 | Bilanzich | 126/204 |
| 5,992,407 A | | 11/1999 | Tsai | |
| 6,207,236 B1 | * | 3/2001 | Araki et al. | 427/386 |
| 6,425,387 B1 | * | 7/2002 | Rohback, Jr. | 126/9 R |
| 6,918,387 B2 | * | 7/2005 | Klarich et al. | 126/201 |
| 7,047,963 B2 | * | 5/2006 | Van Vleet | 126/512 |
| 8,074,969 B2 | * | 12/2011 | Lee et al. | 256/73 |
| 2003/0034023 A1 | * | 2/2003 | Meurer | 126/29 |
| 2004/0250807 A1 | * | 12/2004 | Reiner | 126/9 R |
| 2006/0144386 A1 | | 7/2006 | Cho | |

FOREIGN PATENT DOCUMENTS

CA 2197906 3/1997

* cited by examiner

*Primary Examiner* — Ramon Ramirez
*Assistant Examiner* — Todd M Epps
(74) *Attorney, Agent, or Firm* — McDonald Hopkins LLC

(57) ABSTRACT

A windscreen having base positionable adjacent a fire, a first body portion removeably secured to the base in a substantially vertical orientation, and a securing member connected to the first body portion and capable of removeably securing a second body portion above or next to the first body portion.

8 Claims, 4 Drawing Sheets

104
105
105
100
30

135
7
7
60
50
30
145
20
10
145
30

97
30
110
135
145
20
10
30
140
60
110
30

82
80
20
30
90
72
72
145
30
145
50

85
30

20
85
90
80
95
72

WINDSCREEN FOR FIRE

CROSS-REFERENCE TO RELATED APPLICATIONS

This application claims benefit to provisional application No. 60/925,986, entitled "WIND GUARD FOR FIRE PIT," filed Apr. 24, 2007, which is hereby incorporated in its entirety by reference.

FIELD OF THE INVENTION

The present invention is generally related to screens, and in particular, to windscreens for use with a fire.

BACKGROUND OF THE INVENTION

One problem associated with maintaining a fire is having suitable protection from the wind. Exposure to the wind can cause a variety of problems with starting the fire, containing the fire, maintaining the fire, and dissipating the smoke into the air.

For example, a fire pit can serve several purposes, making it an appealing structure to have in a yard of a home. In addition to complimenting the landscape of the yard, a fire pit offers warmth and light to observers. However, one of the drawbacks of the outdoor fire pit is that wind tends to blow smoke and ash into the direction of the observers, creating an uncomfortable experience. Therefore, it is desirable to provide a windscreen capable of overcoming these and other drawbacks.

SUMMARY OF THE INVENTION

In one aspect, the present invention is directed to a windscreen having base positionable adjacent a fire, a first body portion removeably secured to the base in a substantially vertical orientation, and a securing member connected to the first body portion and capable of removeably securing a second body portion above or next to the first body portion.

In another aspect, the present invention is directed to a windscreen having a base positionable adjacent a fire and defining a channel, a body portion removeably secured to the base to support the body portion in a substantially vertical orientation, the body portion is slideably received within the channel such that the body portion is selectively positionable along said base.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings. It is to be understood that both the foregoing general description and the following detailed description are exemplary and explanatory and are intended to provide further explanation of the invention as claimed.

DESCRIPTION OF THE DRAWINGS

The preferred embodiments may be better understood by reference to the following illustrations.

DETAILED DESCRIPTION OF THE PREFERRED EMBODIMENTS

While the present invention is described with reference to embodiments described herein, it should be clear that the present invention is not limited to such embodiments. Therefore, the description of the embodiments herein is merely illustrative of the present invention and will not limit the scope of the invention as claimed.

Figure 1:
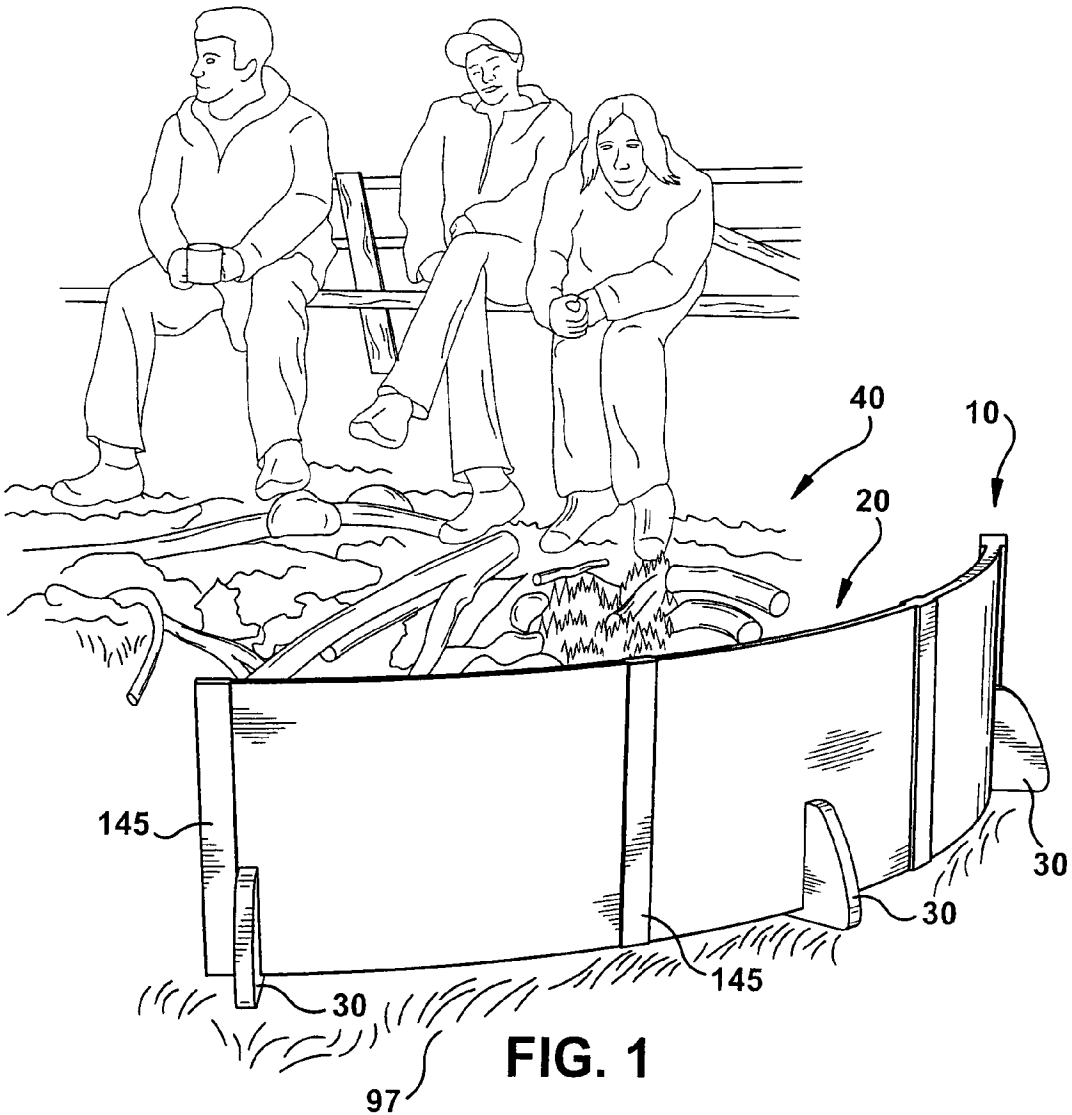
FIG. 1 is a rear view of a preferred embodiment of a windscreen.

As generally described herein, FIGS. 1-9B illustrate embodiments of a windscreen 10. As shown in FIG. 1, the windscreen 10 generally comprises a body portion 20 removeably secured to one or more bases 30. The windscreen 10 is capable of being positioned adjacent a fire 40, for example, to protect the fire 40 from the wind. It is to be understood that the windscreen 10 may provide protection from the wind while starting the fire, while containing the fire, and while cooking over the fire. Such protection may also allow the smoke generated from the fire to travel upwardly and dissipate in the air and prevent ash and/or smoke from being blown in an area surrounding the fire.

Figure 2B:
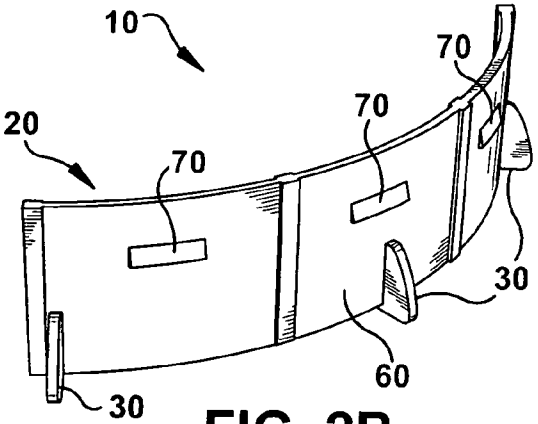
FIG. 2B is a rear view of the windscreen of FIG. 2A.
Figure 2A:
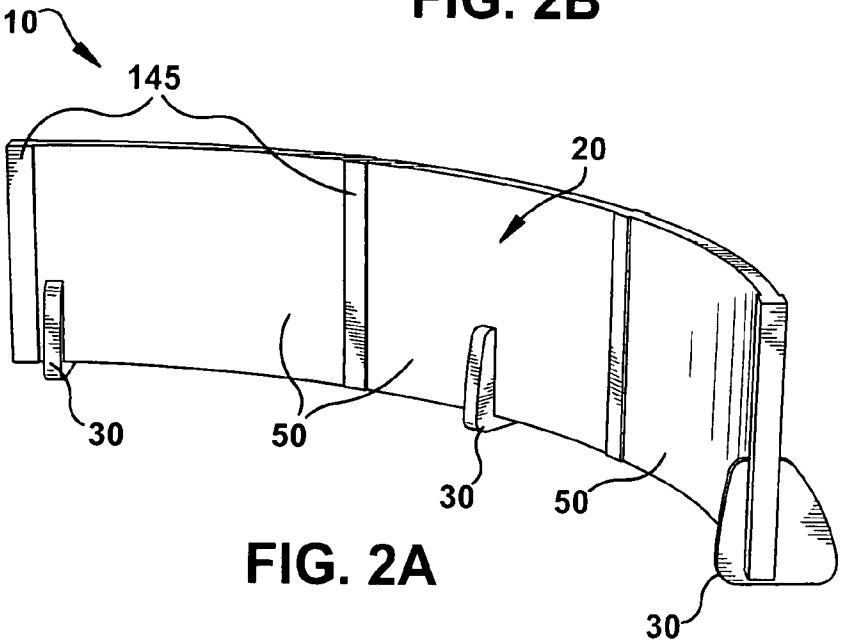
FIG. 2A is a front view of a preferred embodiment of a windscreen.

As best shown in FIGS. 2A and 2B, the body portion 20 has a first side 50 capable of being positioned adjacent the fire 40, and a second side 60 opposite the first side 50 to face away from the fire 40. It is to be understood that the first side 50 may be constructed from any material including, but not limited to, metal, such as steel or aluminum, glass, plastic, refractory materials, ceramics, composites, and the like. For example, the first side 50 may be constructed from a fireproof material or a heat reflective material capable of reflecting heat away from the first side 50. In a non-limiting example, the body portion 20 may be made from a material capable of being rolled into a substantially cylindrical shape for shipping or storage.

It is to be understood that the second side 60 may be constructed from any material including, but not limited to, the materials used for the first side 50. In a non-limiting example, the first side 50 and second side 60 may be a see-through or clear material, such as glass or plastic. It is also to be understood that the first side 50 and second side 60 may be provided in a variety of finishes, including, but not limited to a polished finish.

In a non-limiting example, the second side 60 may be constructed of a material having low thermal conductivity. Illustrative examples include, but are not limited to, composites, fireproof boards, blankets, and the like. One or more handles 70 may be connected to or positioned along the second side 60 to allow the wind screen 10 to be carried or otherwise repositioned. As the second side 60 is constructed of a low conductivity material, the handles 70 are capable of remaining cool to the touch to allow a person to reposition the windscreen 10 without gloves or tools. Although the handles 70 are shown as integral with the second side 60, one of ordinary skill in the art will appreciate that a variety of handles 70 may be used.

As shown in FIG. 1, the body portion 20 may be removeably secured to the base 30 to support the body portion 20 in a substantially vertical orientation along a surface 97. As used herein, the surface 97 may include, but is not limited to, the ground, grills, grill supports, fire pit walls, and the like.

Figure 3A:
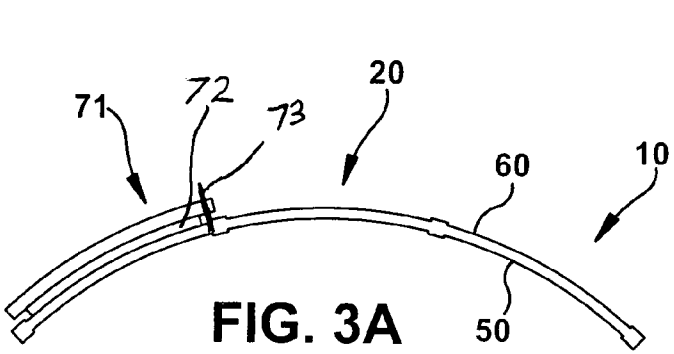
FIG. 3A is an overhead view of a preferred embodiment of a windscreen with a horizontal member in a first position.
Figure 3B:
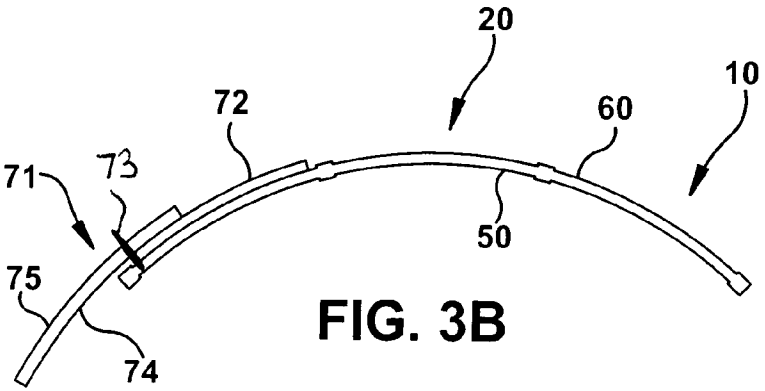
FIG. 3B is an overhead view of the windscreen of FIG. 3A with the horizontal member in a second extended position.

As shown in FIG. 1, the body portion 20 may have a curved shape. In an embodiment, the body portion 20 may be provided with one or more securing members 72 for removeably securing additional body portions 71, 80, and 82. Such a configuration reduces the size of the windscreen 10 during transportation and storage. For example, the securing member 72 may be positioned along one or more ends of the body portion 20 to secure a body portion 71 (hereinafter referred to as "the horizontal member 71") thereto. In an illustrative example, as shown in FIGS. 3A and 3B, the securing member 72 may be positioned on or along the side 60 to removeably secure the horizontal member 71. As shown in FIGS. 3A and 3B, the securing member 72 may be in the form of a rail or track that allows for the selective positioning of the horizontal member 72 along the body portion 20. The securing member 72 may also be in the form of a protrusion capable of insertion in a corresponding channel (not shown) along the horizontal member 71 that allows the horizontal member 71 to be selectively positioned therealong. Accordingly, the horizontal member 71 may be selectively positioned from a first position as shown in FIG. 3A to a second extended position as shown in FIG. 3B, and any position therebetween. In either position as shown in FIGS. 3A and 3B, the body portion 20 and horizontal member 71 may form a curved shape capable of surrounding at least a portion of a fire.

It is to be understood that a locking mechanism 73 may be provided to secure the horizontal member 71 at any point between the first to the second position. The locking mechanism 73 may include, but is not limited to, pins, bolts, and the like. For example, the body portion 20 and horizontal member 71 may be provided with a series of apertures (not shown) capable of coaxial alignment for insertion of a pin or bolt therein to secure the horizontal member 71 at a desired position along the body portion 20. It is also to be understood that a fireside 74 and a backside 75 of the horizontal member 71 may be constructed of the same material as the first side 50 and second side 60, respectively.

Figures 4, 5, 6A, 6B, 7:
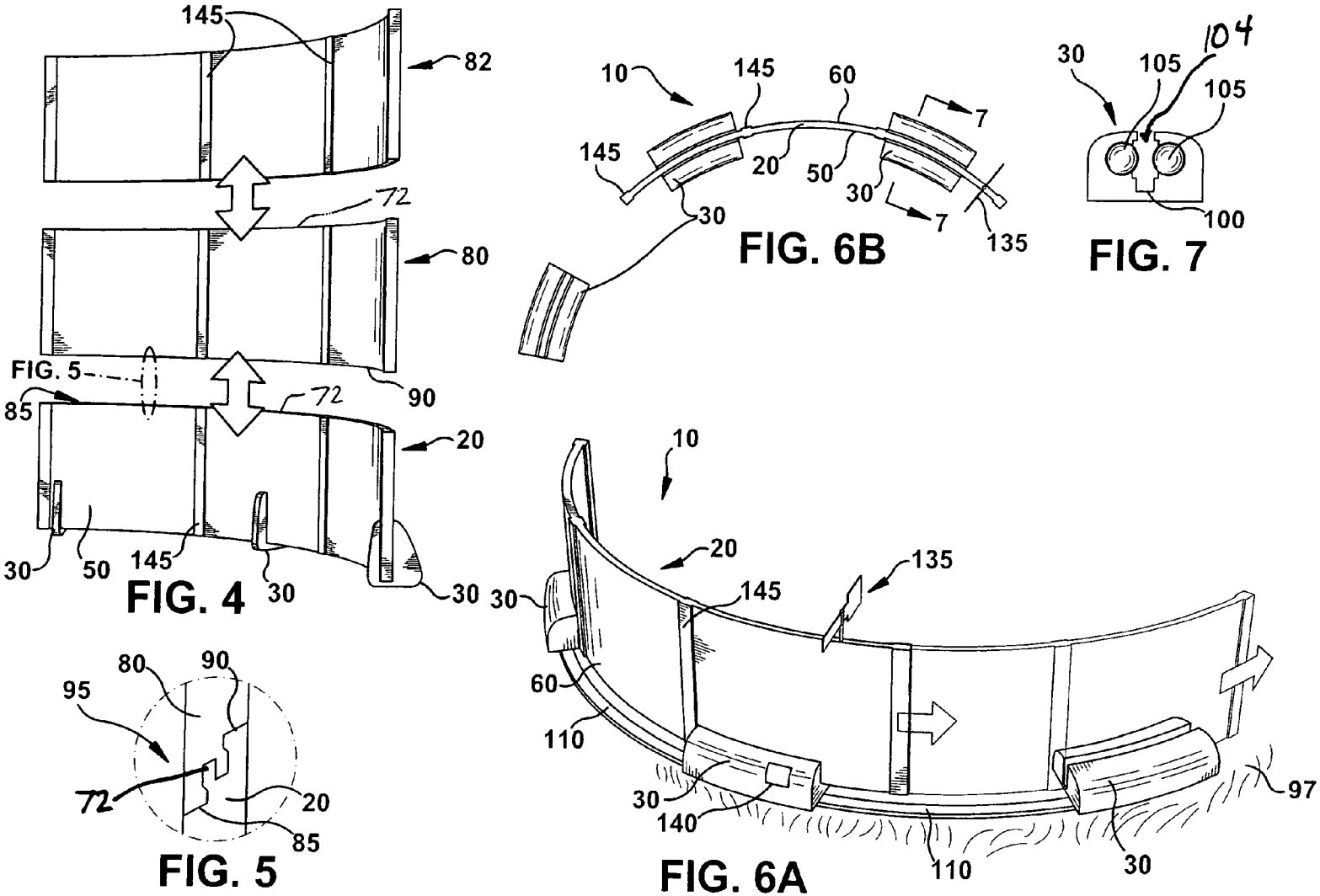
FIG. 4 is a front view of a preferred embodiment of a windscreen with a vertical member.
FIG. 5 is a partial cross-sectioned view of a preferred embodiment of a securing member.
FIG. 6A is a rear view of a preferred embodiment of a windscreen slidably secured to a base.
FIG. 6B is an overhead view of the windscreen of FIG. 6A.
FIG. 7 is a cross-sectional view of a base in a preferred embodiment.

In another embodiment, as best shown in FIG. 4, one or more body portions 80, 82 (hereinafter referred to as "the vertical members 80, 82") may be provided. The vertical member 80 is capable of being removeably secured to the body portion 20 via the securing member 72, and extending vertically from the body portion 20. In a non-limiting example, as shown in FIG. 5, the securing member 72 may be in the form of one or more protrusions extending from the top 85 of the body portion 20. The bottom 90 of the vertical member 80 may be shaped to receive the securing member 72, for example, to form an interlock 95 with the securing member 72. It is to be understood, however, that one of ordinary skill in the art will appreciate that a variety of different securing members 72 may be used to removeably secure one or more of the horizontal member 71 and the vertical members 80, 82 to the body portion 20. It is also understood that the vertical member 80 may also be provided with a securing member 72 to removeably secure the vertical member 82 to the vertical member 80.

In an embodiment as shown in FIGS. 6A and 6B, the body portion 20 may be removeably secured to the base 30 in a slidable manner to allow the body portion 20 to be repositioned if, for example, the direction of the wind changes. As shown in FIG. 7, the base 30 may define a channel 100 capable of slidably receiving the body portion 20 therein. The base 30 may have a ball bearing portion 104 through which the body portion 20 extends. The ball bearing portion 104 may include one or more ball bearings 105 capable of engaging the sides 50, 60 to facilitate sliding the body portion 20 along the channel 100. As shown in FIGS. 6A and 6B, one or more additional bases 30 may be provided to increase the area that the body portion 20 may be positioned about the fire 40.

Figure 8A:
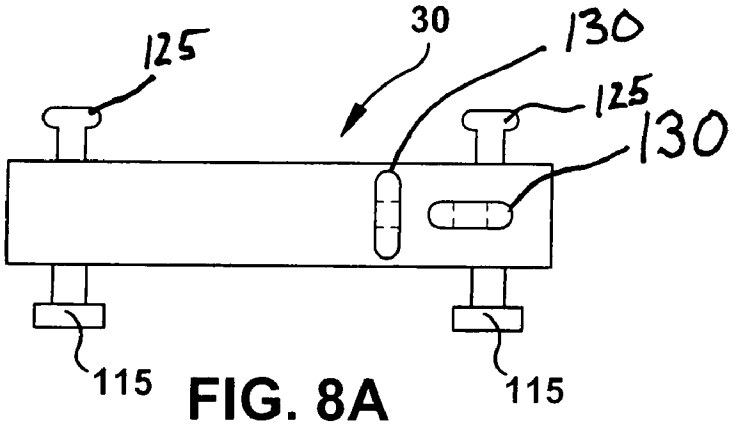
FIG. 8A is a side view of a base in a preferred embodiment.
Figure 8B:
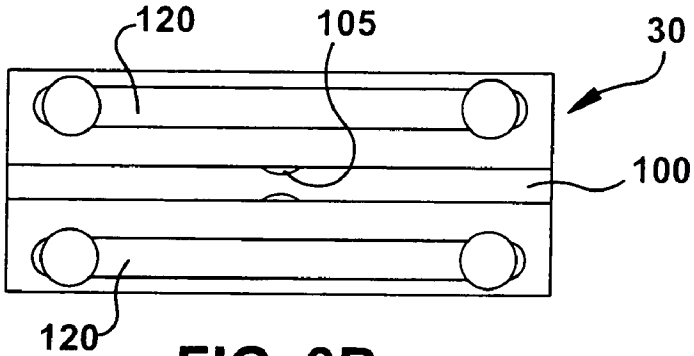
FIG. 8B is an overhead view of the base shown in FIG. 8A.

It is also to be understood that one or more connectors 110 may be provided for connecting a plurality of bases 30 along the path of the body portion 20. As shown in FIGS. 8A and 8B, the bases 30 may have selectively positionable feet 115 to accommodate uneven surfaces. For example, one or more grooves 120 may be provided along the length of the base 30 for selectively positioning the feet 115 therealong. For example, a knob 125 may be turned to loosen the feet 115 so that the feet 115 may be positioned along the groove 120 in a desired location. The feet 115 may be secured at a desired position by tightening the knob 125. It is to be understood, however, that one of ordinary skill in the art will appreciate a variety of other configurations for selectively positioning the feet 115 horizontally along the groove 120.

In addition, or alternatively, the feet 115 may be vertically adjustable. For example, the feet 115 may be capable of telescoping or otherwise extending to a desired elevation. In a non-limiting example, a level indicator 130 may be provided on the base 30 to facilitate proper alignment.

As shown in FIGS. 6A and 6B, the windscreen 10 may be provided with a wind sensor 135 capable of detecting the direction of the wind to facilitate proper positioning of the windscreen 10 adjacent the fire 40. In an illustrative example, the wind sensor 135 may be a windsock, weather vane, sail or other such device capable of automatically repositioning the body portion 20 along the bases 30 in response to the direction of the wind. It is to be understood that the wind sensor 135 may have many orientations with respect to the body portion 20, and that more than one wind sensor 135 may be utilized with the body portion 20.

In another illustrative example, a motor 140 may be provided that is capable of repositioning the body portion 20 along the base 30. A user, for example, may operate the motor 140 manually to selectively position the body portion 20 along the base 30. It is also to be understood that the wind sensor 135 may be operatively connected to the motor 140 so that the wind sensor 135 activates the motor 140 to position the body portion 20 in response to the direction of the wind. As shown in FIG. 6A, the motor 140 may be incorporated into one or more bases 30, and may for example rotate the ball bearings 105 to position the body portion 20 along one or more bases 30. However, it is to be understood that a variety of configurations may be utilized to allow the motor 140 to position the body portion 20. For example, the motor 140 may be a stand-alone unit separate from the base 30. It is also to be understood that any motor 140 may be used including AC and DC motors, and power may be supplied from any source including batteries.

Figure 9B:
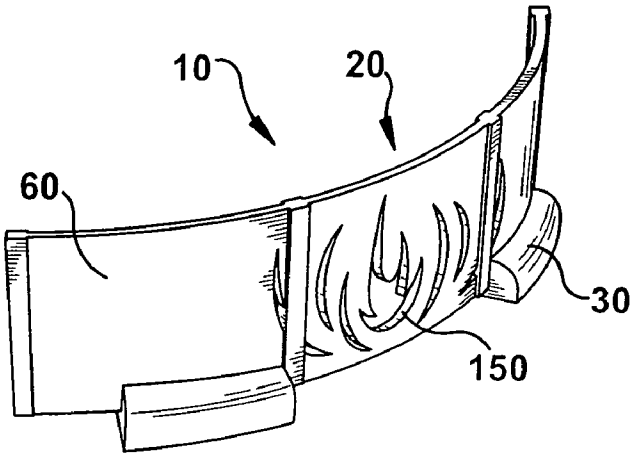
FIG. 9B is a rear view of the windscreen of FIG. 9A.
Figure 9A:
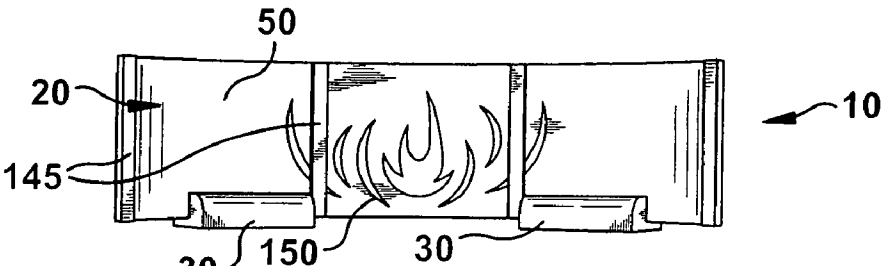
FIG. 9A is a front view of a preferred embodiment of a windscreen.

It is to be understood that the windscreen 10 may be of any size, and in one illustrative example has a radius 20% larger than the fire or fire pit and the body portion 20 ranges from one to four feet high. It is also to be understood that a variety of other modifications and alterations can be made to the windscreen 10. In an illustrative example, ribs 145 may be provided for increased stability. In another non-limiting example as shown in FIGS. 9A and 9B, the windscreen 10 may include cut out or screened on designs 150 for a more decorative and customized appearance.

The invention has been described above and modifications and alternations will occur to others upon a reading and understanding of this specification. The claims as follows are intended to include all such modifications and alterations insofar as they come within the scope of the claims or the equivalent thereof.

I claim:

1. A windscreen comprising:

a plurality of bases selectively positionable adjacent a fire;

a first body portion removably secured to said bases in a substantially vertical orientation, the first body portion being disposed within a channel of said bases;

a second body portion removably secured to said first body portion; and a securing member connected to said first body portion capable of removably securing said second body portion in a position above said first body portion, said securing member having two or more protrusions, and wherein said securing member extends along a vertical end of said first body portion.

2. The windscreen of claim 1 wherein said securing member defines a railing along said first body portion along which said second body portion may be selectively extended vertically beyond an end of said first body portion.

3. The windscreen of claim 1 further comprising a locking mechanism for securing said second body portion in a fixed position along said securing member.

4. The windscreen of claim 1 wherein said first body portion is substantially curved.

5. The windscreen of claim 1 wherein said first body portion is capable of being rolled into a substantially cylindrical shape for storage.

6. The windscreen of claim 1 wherein said first body portion has a first side comprising a heat reflective material oriented toward said fire.

7. The windscreen of claim 6 wherein said heat reflective material has a decorative finish.

8. The windscreen of claim 6 wherein said first body portion has a second side comprising a composite material opposite said first side.

* * * * *